United States Patent [19]

Rodi

[11] Patent Number: 5,036,764

[45] Date of Patent: Aug. 6, 1991

[54] METHOD AND DEVICE FOR REDUCING REGISTER ERRORS IN MULTICOLOR ROTARY-PRINTING MACHINES

[75] Inventor: Anton Rodi, Leimen, Fed. Rep. of Germany

[73] Assignee: Heidelberger Druckmaschinen AG, Heidelberg, Fed. Rep. of Germany

[21] Appl. No.: 939,228

[22] Filed: Dec. 8, 1986

Related U.S. Application Data

[63] Continuation of Ser. No. 717,113, Mar. 28, 1985, abandoned, which is a continuation-in-part of Ser. No. 626,450, Jun. 28, 1984, abandoned, which is a continuation of Ser. No. 447,712, Dec. 7, 1982, abandoned.

[30] Foreign Application Priority Data

Dec. 8, 1981 [DE] Fed. Rep. of Germany ..... 3148449

[51] Int. Cl.[5] ..... B41F 5/22; B41F 33/16

[52] U.S. Cl. ..... 101/211; 101/181

[58] Field of Search ..... 101/181, 136–140, 101/178, 211, 183, 248; 226/2, 3, 24, 25, 28, 29, 30, 31; 364/468–471

[56] References Cited

U.S. PATENT DOCUMENTS 3,452,261 6/1969 Tagliasacchi ..... 101/181 X
4,495,582 1/1985 Dessert et al. ..... 101/248

FOREIGN PATENT DOCUMENTS 3148449 6/1983 Fed. Rep. of Germany ..... 101/181
2024457 1/1980 United Kingdom ..... 101/181

*Primary Examiner*—J. Reed Fisher
*Attorney, Agent, or Firm*—Herbert L. Lerner; Laurence A. Greenberg

[57] ABSTRACT

Method of reducing register errors in multicolor offset printing machines having printing units driven by a common motor and having a register adjusting device, which includes determining and storing a functional relationship between a quantity of torque delivered by the common motor and a quantity characteristic of the torque, on the one hand, and a register adjustment necessary for maintaining satisfactory register, on the other hand, monitoring the quantity during operation of the printing machine, and setting the register adjustment to a value functionally associated with the respective torque.

19 Claims, 5 Drawing Sheets

PREPARE TABLES

OPERATE MACHINE FROM TABLES

METHOD AND DEVICE FOR REDUCING REGISTER ERRORS IN MULTICOLOR ROTARY-PRINTING MACHINES

CROSS REFERENCE TO RELATED APPLICATIONS

This application is a continuation of U.S. application Ser. No. 717,113, filed Mar. 28, 1985, now abandoned, which is a continuation-in-part of application Ser. No. 626,450, filed June 28, 1984, now abandoned, which is a continuation of Ser. No. 447,712, filed Dec. 7, 1982, now abandoned.

BACKGROUND

The invention relates to a method and device for reducing register errors in multicolor rotary printing machines and more particularly, in multicolor offset printing machines having printing units driven by a common motor and having a register-adjusting device.

The production of satisfactory multicolor prints presupposes that the printing plates used for printing the different colors are in exact registry with one another i.e. they coincide or match up with great accuracy in the paper travelling through the printing machine. In order to achieve this exact coincidence, such printing machines are provided with register-adjusting devices which permit mutual adjustment about small angular values of the respective cylinders carrying the printing plates in the consecutive printing units.

A particular difficulty encountered in register adjustment is that the angular position of the cylinders carrying the printing plates is not rigid or fixed with respect to the drive shaft but rather, because of the unavoidable elasticity of the materials used, is dependent upon the torque which must be applied for driving the printing machine. This torque is greatest at the drive motor, and decreases therefrom along the drive chain extending to the individual printing units. Consequently, the torque-dependent angular displacement of the cylinder carrying the printing plates is different from that of the drive shaft, from which it also follows that the angular displacement of the cylinders carrying the printing plates is different from one another and is dependent upon the magnitude of the torque. Because, on the other hand, the torque to be applied by the drive motor is a function of the operating speed of the printing machine, an exact register adjustment can be effected only at the desired printing rate, which results in the production of considerable waste of paper before the correct register setting is attained, when the printing machine is being set up at high speeds.

To remedy this deficiency, automatic register-adjustment devices have been provided heretofore which include machine-readable markings on the cylinders carrying the printing plates, as well as sensors which are responsive to these markings and deliver signals to a control unit which enable the control unit to ensure good coincidence or matching of the printed images through suitable register adjustment. Such a device is very costly, however, and is, especially disadvantageously, not readily applicable for retrofitting on existing printing machines.

It is accordingly an object of the invention to provide a method and a device for preventing register errors in multicolor rotary printing machines which, after precise adjustment or setting of the registry at any desired and especially low speed, permits the operating speed of the printing machine to be changed without again losing the registry setting.

With the foregoing and other objects in view, there is provided, in accordance with the invention, a method for reducing register errors in multicolor offset printing machines having printing units driven by a common motor and having a register adjusting device, which includes determining and storing a functional relationship between a quantity selected from a group of quantities consisting of the quantity of torque delivered by the common motor and a quantity characteristic of the torque, on the one hand, and a register adjustment necessary for maintaining satisfactory register, on the other hand, monitoring the quantity during operation of the printing machine, and setting the register adjustment to a value functionally associated with the respective torque.

Because the torque-dependent angular displacement of the plate cylinders with respect to the drive shaft is dependent upon the mechanical construction and especially, upon the elasticity characteristics of the materials which are used, a specific characteristic of the respective printing machine is involved which is not subject to any appreciable variations with respect to time. Therefore, while the printing machine is operating slowly, the pressman can set up a satisfactory registry or coincidence of the individual printed images, and this registry or coincidence is maintained even if the machine is brought up to high speed, because the register adjustment necessary for maintaining the registry or coincidence is known and is performed automatically. Likewise, the invention prevents register errors which might otherwise occur due to fluctuations in operating conditions, for example due to a rise in the operating temperature with consequent reduction in the torque-requirement with increasing operating or running time after start-up of the printing machine. The method according to the invention, therefore, permits the printing machine to be set up at low speed with correspondingly low consumption or wastage of material, and ensures the maintenance of good registry at the desired printing rate even under changing operating conditions, without requiring recourse to be taken to heretofore known, complicated control equipment. On the contrary, a relatively simple control based upon the once-determined functional relationship between the torque delivered by the motor and the necessary register adjustment is sufficient.

Of particular advantage is that a device for implementing the method according to the invention can be installed on each printing machine, even retrofitted on already existing machines, because it is merely necessary to install a device for monitoring the torque delivered by the motor or a quantity characteristic of the torque and to connect it to a control device having a memory wherein register adjustment values are stored which are associated with different torques, the control device being connected to the register-adjustment device of the printing machine in such a manner that the control device, depending upon the measured torque, effects a setting of the register to the associated, stored value.

Therefore, in accordance with another aspect of the invention, there is provided a device for reducing register errors in multi-color offset printing machines having printing units driven by a common motor and having a register-adjusting device, including means for monitoring a quanity selected from a group of quantities consisting of the quantity of torque delivered by the common motor and a quantity characteristic of the torque, and a control unit including a memory with register adjustment values associated with different torques stored therein, the control unit being actuatable for setting the register adjustment to the respective associated stored value in accordance with the monitored selected quantity. In this regard, it is believed to be readily apparent that, in offset printing machines, besides the cylinders carrying the printing plates, the blanket cylinders may also be adjusted in order to prevent image displacement on the rubber blanket and consequent spoiled prints.

In accordance with another mode of the invention, the method includes measuring the torque at the drive shaft. To accomplish this, the application of resistance strain gauges may be sufficient. It is also possible, however, to install, for example, piezoelectric torque sensors in the drive shaft of the motor. It is even simpler, in accordance with an alternative mode of the invention, to provide a method which comprises measuring the current consumption of the common motor in order to determine the torque. Even if the functional relationship between torque and current consumption or other operating variables of the motor is not linear, this is of no special importance if, as in accordance with other alternate modes of the invention, the method comprises determining the functional relationship either by at least one trial run or by computation or calculation.

With regard to a practical implementation of the method according to the invention, in accordance with yet an additional mode of the invention, the method includes storing the functional relationship between the torque or a quantity characteristic thereof and the register adjustment in the form of a table of values, because the data obtained in the table of values can then be processed by conventional computation devices, especially a digital processor.

In principle, the values corresponding to different register adjustments are then stored at addresses corresponding to different torques so that the measuring of a specific torque and a quantity characteristic thereof, respectively, results in the addressing of a specific memory location, while the value present at the memory location determines the register adjustment associated with the torque. The transfer of this value into the desired register adjustment can be effected readily with conventional control means. Likewise, it is apparent that it is readily possible to convert the measured torque into a digital value corresponding directly to a memory address.

Although the functional relationship between torque and register adjustment is a characteristic of the respective printing machine, this characteristic may also depend upon external factors, for example the temperature, since the elasticity of the materials is also temperature-dependent. Furthermore, the register adjustment depends upon the manner of distributing the loading over the device chain, so that the use of inks of different viscosity may also have an effect upon register adjustment. Furthermore, the register adjustment depends upon the material which is used as the printing carrier, thus for example upon the composition and thickness of the paper used, and perhaps also on film or plastic material or even pieces of textile material. Accordingly, the invention also includes a method which comprises determining the functional relationship between the torque or a quantity characteristic of the torque and the register adjustment for different conditions, such as different temperatures, using inks of different viscosities and/or using different materials as print carriers, and controlling the register adjustment for each of the different conditions prevailing. Such an influencing condition may be, for example, the shutting-down of one or more printing units, or general shifts in the torque due to changes of functions.

Other features which are considered as characteristic for the invention are set forth in the appended claims.

Although the invention is illustrated and described herein as embodied in a method and device for reducing register errors in multi-color rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
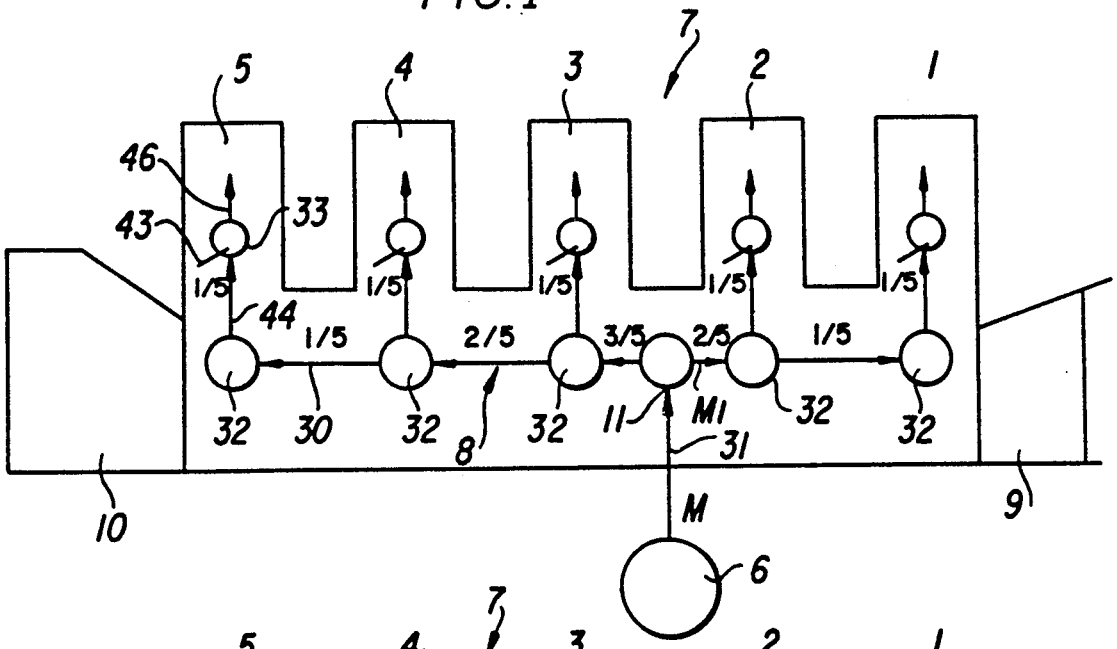
FIG. 1 is a diagrammatic side elevational view of a five-color sheet-fed rotary printing machine having a power feed input between the second and third printing unit thereof, the division of the power being shown schematically as fractions therein.

Referring now to the drawing and first, particularly, to FIG. 1 thereof, there is shown diagrammatically a five-color sheet-fed offset printing machine 7 consisting of five color printing units 1, 2, 3, 4 and 5, all coupled together by a common drive train 8 having a driving motor 6 applying driving power between the second and the third printing unit 2 and 3, especially, of the machine 7 to the diagrammatically indicated gear train 8. Assuming as a main consideration that each printing unit 1–5 has the same torque requirement, and a diagrammatically represented sheet feeder 9 as well as a sheet receiver 10 and other accessory equipment are assumed to require no drive power from the drive train 8. It can be assumed that a torque distribution numerically indicated in FIG. 1 by fractions having a denominator of e.g. 5 for a maximum speed $\eta_{max}$ of the printing machine 7 is produced. Let it further be assumed that the torque applied by the motor 6 is expressed as T1, e.g. in kilogram-centimeters measured on the shaft 31. Accordingly, the total torque M applied by the drive motor 6 is divided in the ratio 2:3 at the power input location, the drive gear 11 between the printing units 2 and 3 since there are two printing units 1 and 2 to the right hand side of the drive gear 11, and three printing units to the left hand side. Accordingly, the torque requirement and consumption of 1/5M of the total torque M is produced for each individual printing unit. Two-fifths of the divided torque is used for the torque supply of the first and second printing units 1 and 2, while the remaining 3/5 of the torque is divided evenly by the printing units 3, 4, and 5.

Figure 3:
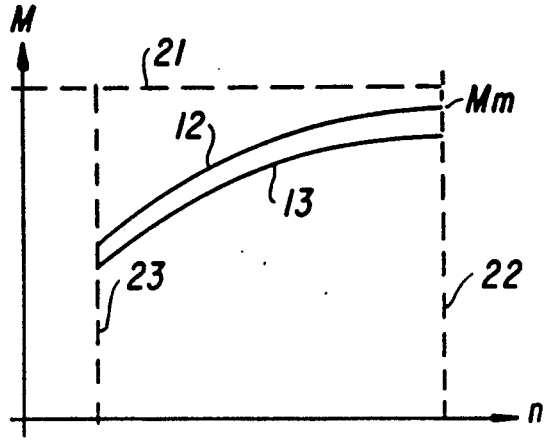
FIG. 3 is a torque diagram for the printing machine of FIG. 1 and 2.

It follows that if a printing unit, such as the printing unit 2 of FIG. 3 is not loaded with paper or subjected to loading, it does not draw any power so that the torque requirement of the printing machine 7 and, accordingly, the torque to be applied by the drive motor 6 will then be only 4/5 of the total torque M, and therefore, only 1/5 of the torque M is required for the printing units 1 and 2 at the point M1 while 3/5 of the torque M is used for the printing units 3, 4 and 5.

Figure 2:
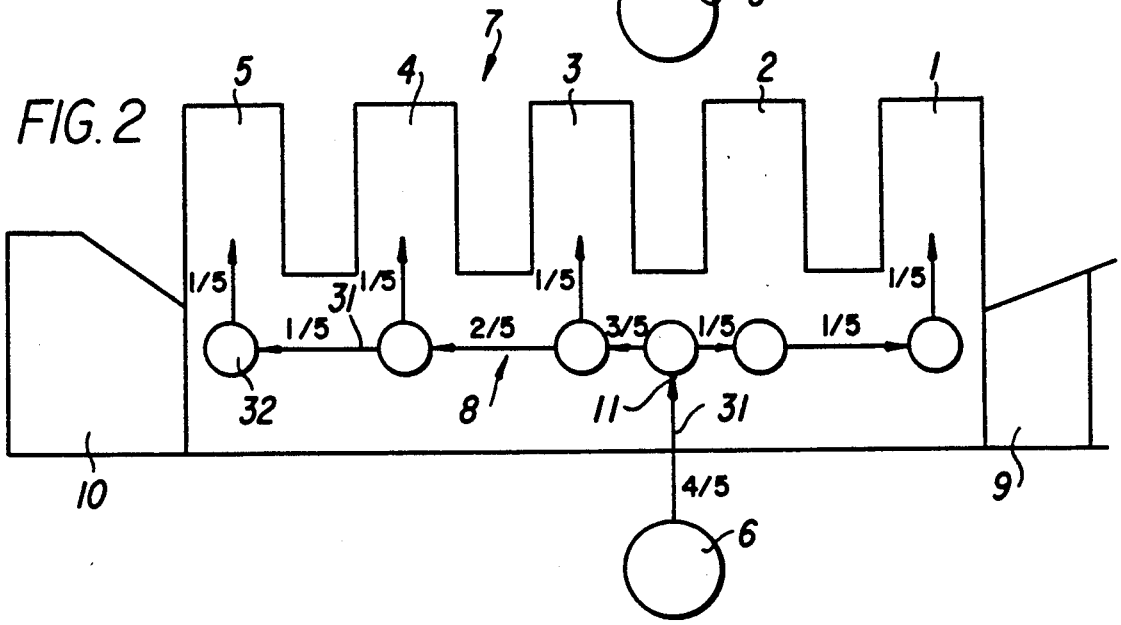
FIG. 2 is another view of FIG. 1 showing the second printing unit without load.

In the torque diagram of FIG. 3, the total torque requirement for a printing machine 7 according to FIGS. 1 and 2 as a function of increasing machine speed $\eta$ is indicated, the ordinate of the plot diagram representing the torque M and the abscissa the rotary speed $\eta$ of the machine. The maximum torque M=1.00% available from the drive motor 6 is, moreover, shown by the reference line 21 on the ordinate, and the maximum speed $\eta_{max}$ of the printing machine is indicated on the abscissa by the reference line 22. Initially, when the printing machine is started up from a speed $\eta=0$, frictional resistances occur which must be overcome; therefore, the beginning of the torque curves 12 and 13 as shown first at a machine speed 23, after the starting torque has been overcome, are consequently relatively small. The torque curve 12 is characteristic for the torque in a printing machine according to FIG. 1, and the curve 13 for the torque of a printing machine according to FIG. 2 in which one printing unit 2 has been unloaded. In this regard the respective drive motor 6 is constructed so that it is capable of delivering the maximum torque requirements Mm. The drive motor 6 therefore always operates in the partial load range, for example, at about 80% of its full load.

In order to more clearly describe the invention, some of the details of the physical construction of a typical multi unit printing machine are described hereinbelow in connection with FIG. 5, which diagrammatically shows details of the drive train 8.

Figure 5:
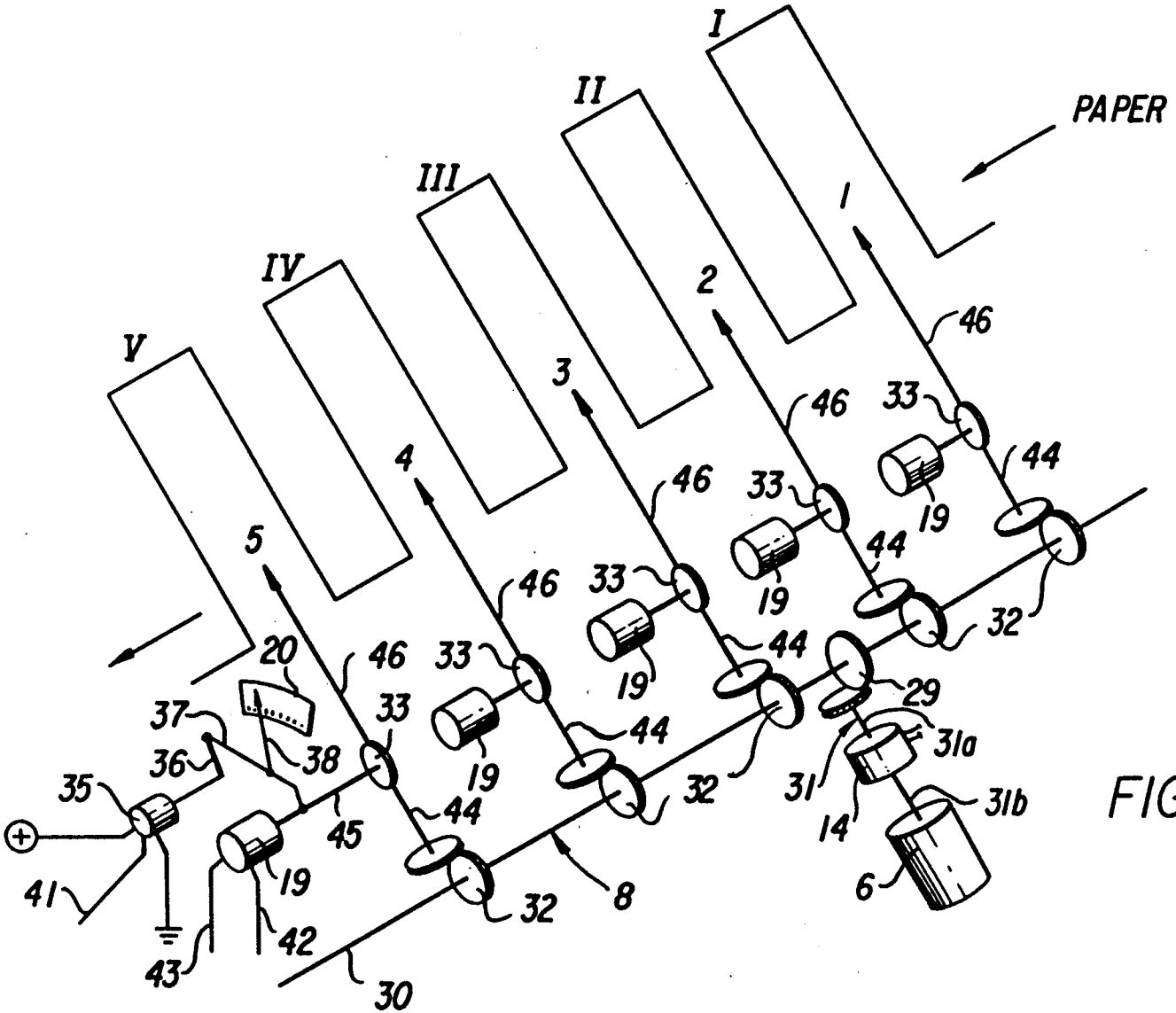
FIG. 5 is a diagrammatic, fragmentary perspective view of the drive train of a printing press, showing registers and shaft angle changers.

It should be noted, however, that the structure shown in FIG. 5 only illustrated one of several possible methods of arranging the transmission of power from a common motor to several printing units, and is therefore shown as an example of one of several preferred embodiments. A somewhat different transmission arrangement is shown in copending U.S. patent application Ser. No. 464,829 by the same applicant, which discloses a hydrodynamic driveshaft coupling instead of the mechanical gearwheel-based arrangement shown in the instant application.

A long horizontal main drive shaft 30 is driven by the motor 6 through the vertical motor shaft 31 and a bevel gear 29. Each of the printing units 1–5 receives its driving power from a corresponding bevel gear 32 for each unit. Each bevel gear 32 consisting of two bevel gear wheels drives a lower vertical drive shaft 44 which in turn drives a vertical upper drive shaft 46 through a drive shaft angle-changer 33, connected by a horizontal angle control shaft 43 to a register control motor 19. The drive shaft angle-changer 33 is a mechanical device that is capable of "twisting" the upper drive shaft 46 a certain angle alpha in relation to the lower drive shaft 44, under control of the angle control shaft 43.

The angle changer 33 may be any suitable mechanical device that can perform such an angle-changing function. Many different devices are well known. A typical device is a three way differential of a construction similar to the differential between drive shaft and the rear axle of automobile. Other forms of angle changers are well known to those skilled in the art of machine design. Using the analogy with an automobile differential, the lower shaft 44 would correspond to one of the driven wheel axles, the angle control shaft correspond to the other driven wheel axle and the upper drive shaft 46 would correspond to the automobile's drive shaft. In operation, as the horizontal main drive shaft 30 is rotating, and turning the lower drive shafts 44, the upper drive shafts will also be turning driven through the interior gear wheels of the angle changers 33, while the angle control shafts 13 would be standing still. The upper drive shafts, in turn, are also turning and driving the corresponding printing units. The loading of the main drive shaft 8 and the intervening drive shafts and mechanical elements naturally causes a certain twisting of all the shafts, and the twisting expressed as an angle alpha in relation to the armature of the motor 6, naturally, will vary as a function of the loading, its distribution and the speed of rotation of the system. It follows that at low speed, the load is light and at high speed, the load is greater and the torque is greater and the resulting angle-alpha measured at different points of the system will be greater and will be different at those different prints. It also follows that the blanket cylinder in each printing unit, which transfers the inked image to the paper will tend to place the image at a slightly different location of the paper, depending on the angle alpha for the particular blanket cylinder. In order to overcome this problem, printing machines typically have an adjustment mechanism, called the register, which enables the printing machine operator to correct for the change in the angle alpha in order to align precisely the color imprints placed on the paper by each of the printing units so that the final image has all the various color images in precisely the same place. The adjustment of the angle alpha is normally performed by turning the angle control shaft 43 a certain angle $\Delta L$ in order to correct for the angle alpha. The angle $\Delta L$ may be indicated on a scale 20 by a pointer 38 attached to the control shaft 43. The control shaft 43 may be connected to a handwheel for adjusting the angle, but may advantageously be connected to a servo register control motor 19 that is controlled from a control desk.

Since printing presses are usually operated at different speeds such as at low speed when performing all the various adjustments when a new printing run is started, and then, at a high speed when the adjustments are completed. At high speeds, the angles alpha in the various parts of the press increase and new adjustments are required for the various registers 38, 43, which leads to waste of time and paper until the proper registration of the printings is again established.

In seeking solutions to this problem, applicant has discovered, as explained hereinabove that there is a predictable relationship between the rotary speed of the motor 6 and the angle alpha at the various printing units 1–5. This relationship is a function of the torque applied by the motor 6, which is again a function of the rotary speed of the motor 6. The figure M is shown, as an example, in FIG. 3, expressed by the curves 12 and 13. If follows that much of the tedious, time consuming and paper wasting correction for the angle alpha can be eliminated by applying the knowledge of this relationship to the control of the angle changers 33 in FIG. 5. The instant disclosure shows apparatus for performing the adjustments automatically, based on this knowledge.

Due to the functional correlation between torque and register adjustment, preferably in a trial run either for a series of printing machines of the same type line or for each machine separately, taking into account further parameters such as temperature changes, type and thickness of the printing carrier, type and composition of the printing inks, and so on, the characteristic values of the corresponding register adjustments for these torque curves are determined in the individual speed ranges. According to FIG. 4, in addition thereto, the total torque applied by the drive motor 6 is detected by a measurement technique in a torque transducer 14 for monitoring the torque which is transformed into a quantity, such as current I, for example, proportional with the respective torque. The torque transducer 14 divides the motor shaft 31 into a first shaft 31*a* and a second shaft 31*b*.

The values of the measured torque converted in this manner are stored in a memory 15 associated with a control unit 16. The memory 15 may be constructed as an internal memory of the control unit 16 or, as an external memory unit.

The control unit 16, preferably an electronic computer, is coupled with a control console 17 having a non-illustrated conventional keyboard by means of which control commands for adjusting the registration of the individual printing units 1 to 5 can be introduced. The control unit 16 also has an electronic logic system 18 connected thereto, which receives parameters specific to the printing job, the printing machine data and other data, such as ambient temperature and humidity and the like, which affect the torque, measured by the transducer 14, and stores them also in the memory 15.

The control unit 16 is connected with the register motors 19 of the individual printing units 1 to 5. The register motors 19 are coupled also with the memory 15 for the purpose of repeating or remotely indicating the position values thereof, as well as with the display 20 for visually representing the register value in digital or analog form.

Also the functional correlation between the torque and the register adjustment is a characteristic of the respective printing machine 7, this characteristic may also depend upon other factors such as temperature, for example, because the elasticity properties or characteristics of the materials of the mechanical components are indeed temperature-dependent. Furthermore, the register adjustment depends upon how the loads on the transmission chain i.e. the drive train 8, is divided, and also on the use of inks of different viscosity which can have an influence upon the register adjustment. In addition, the register adjustment may depend upon the material used as a print carrier, the papers thus, for example, upon the composition and thickness of the paper which is used, and perhaps also of foils of plastic material or even pieces of textile material. Accordingly, it is advantageous, to determine the functional correlation between the torque and the register adjustment under different conditions and to use the respective functional relationship applicable to the prevailing variable conditions that affect the register adjustment. Such a variable condition may be, for example, the switch-off of one or more of the printing units 1 to 5.

It has been mentioned hereinbefore that the functional relationship between any of the variable quantities that affect the torque can be measured during operation and the necessary register adjustment can be predicted, based on values established by a trial run wherein the register adjustment is recorded and stored in the memory 15 as a function of this quantity for all possible variable conditions. Such a trial run need not be carried out, however, for each individual printing machine 7 because it has been found that printing machines of similar construction respond in similar fashion to the variable quantities.

When the same materials and close manufacturing tolerances are used, it is, sufficient to determine the relationship on a single machine which is a typical exemplary for a machine series or even a machine type, either by means of the hereinabove described trial run, or by means of experimental investigation or possibly exclusively by calculation or computation because, for all other machines of the same series or of the same type, the same functional relationship or correlation between torque and register adjustment has been found to exist.

In the trial run, the torque applied by the drive motor 6 is transformed, at increasing machine speed, in the torque transducer 14 into a value that is proportional or representative of the torque and is entered via the control unit 16 into the memory 15. Simultaneously therewith, by means of the electronic logic system 18, the job, machine and environment dependent variables are continuously measured and stored. With increasing machine speed n, as well as with changing variables such as temperature, choice of the print carriers such as type of paper or the like, use of different printing inks, and so forth, there is a change in setting of the register 38, 43 of the individual printing units and the need for continuous subsequent corrections which are entered by means of the input terminal 17 into the control unit 16 and stored in the memory 15. The values of the register settings are all retrievably stored as a function of the torque as well as of the variable parameters, in the form of a parameter table.

Once a printing machine 7 has been measured as described hereinabove, the measured values can be recalled automatically from the parameter memory 15, by the computer 16, under control of the transducer 14 and the keyboard 17, during running of the machine and, in accordance with these values, the register motors 19 are automatically continuously adjusted and the desired-register adjustment associated with the respective torque as well as the other variable parameters is automatically attained.

Figure 4:
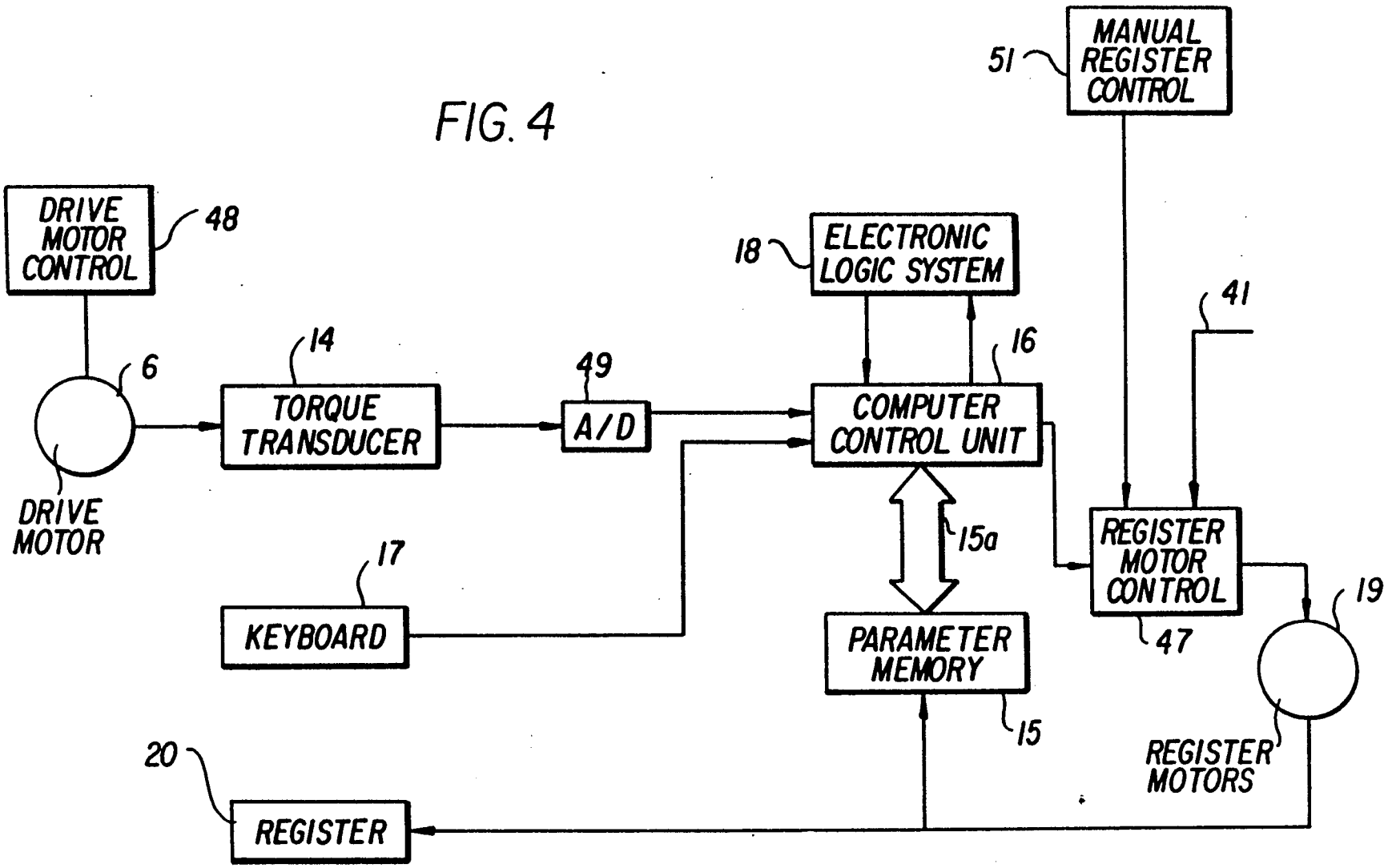
FIG. 4 is a block diagram showing the basic construction of the device according to the invention.

In operation referring to FIG. 4, the drive motor 6 is controlled by a drive motor control 48 by means of which the press operator selects the desired rotary speed of the motor 6, and accordingly, the speed of the entire printing press. The torque transducer 14 connected to the drive motor's drive shaft 31 may be anyone of a number of readily known torque transducers. Optical transducers reading the mutual displacement of two marks on the shaft are well known as well as strain gauges and other types. Typically, a transducer presents an analog voltage or current, which is converted to a proportional digital value in an analog-to-digital converter (A-D) 49 which sends a digital value representing the torque to the computer 16. the digital torque values are used as addresses for the parameter memory 15 to establish a table containing all the register settings, for example, in the form of an angle beta for each of the printing units 1–5, after the registers have been aligned by the press operator using the manual register control 57 acting on the register motor control 47. The manual register control 51, the register motor control 47 and the register motors 19 are all conventional, well known parts of modern printing presses. After a completed table has been prepared for the relation between the torque M and the register settings and stored in memory 15 for all applicable combinations of the variable environmental parameters, such as temperature, type of ink, type of printing medium and so forth, it follows that subsequently, these parameters can be used to set the registers, without the need for tediously adjusting the registers every time the operating conditions are changed. All that is needed, is for the printer to enter the selectable variable parameters at the keyboard 17, such as type of paper, type of ink, and the ambient parameters temperature, humidity and so forth, and by entering the proper commands at the keyboard, the registers 20 may be set automatically by means of the parameters stored in parameter memory 15, via the computer bus 15*a*, the computer 16, the register motor control 47 and register motors 19.

It follows that a very large number of variables and combinations thereof may be required. The computer, however, may have a a computation program for computing, by interpolation, register settings based on variables that are adjacent in value to desired parameter values, not found in the tables.

When using an electronic computer as the control unit 16, the possibility also exists that the computer 16 may register the values which the press operator pressman selects in operation of the press, in order thereby to correct previously stored values on the register adjustment dependent upon the torque, or actually to store such values first. In the subsequent printing operation, the settings or adjustments registered by the control unit 16 are automatically realized, so that the functional relationship at the beginning of the start-up of a printing machine 7 is automatically detected. In this case, the first printing operations after the machine has been put into use may be understood to be the "trial run" for detecting the functional relationship.

Figure 6:
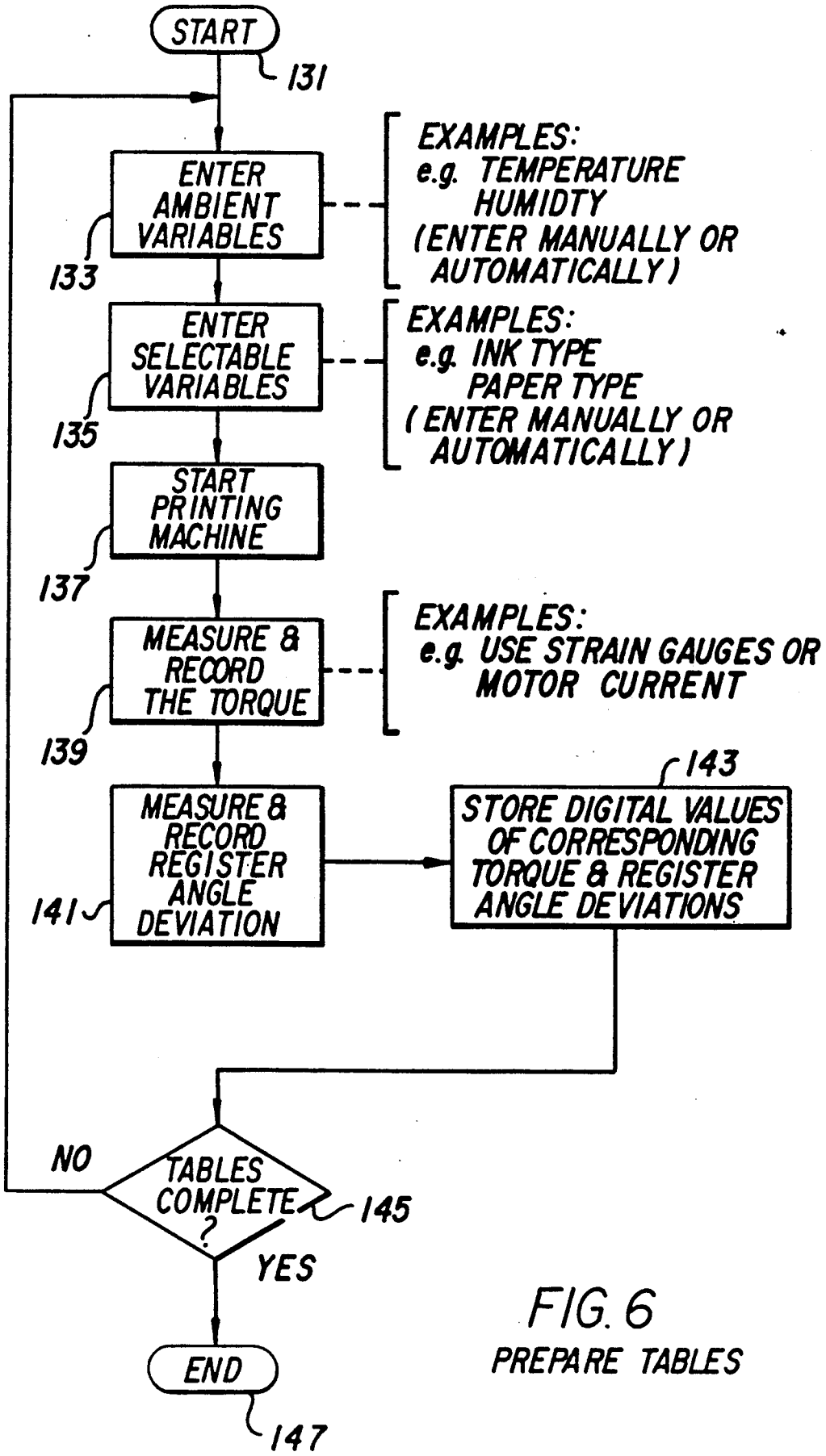
FIG. 6 is a flow-chart showing the steps preparing the parameter table registers.

FIG. 6 is a flow-chart that shows step-by-step the process of preparing the parameter tables in accordance with the apparatus of FIG. 4.

After start, step 131, the ambient variables, such as temperature and humidity are entered at the keyboard 17 or automatically by sensors, in step 133; in step 135, the selectable variables such as ink type, paper type and the like are entered at the keyboard 17. In step 137 the printing machine is started for the purpose of preparing the parameter tables. In step 139 the torque on the drive motor shaft is measured by a torque transducer, such as strain gauges attached to the motor shaft or the like or by measuring the motor input current, and recorded via the A-D converter 49, the computer 16 in the parameter memory 15. In step 141, the corresponding register deviations are recorded at the keyboard 17 or automatically from the register control 51. In step 143, the digital values of the corresponding torque and register deviations are stored in parameter tables, using the torque value as table address. In step 145, if the tables are completed, next step is End, 147; if not, the process returns to step 133 with the selection of a new set of ambient variables of a new set of selectable variables in step 135.

Figure 7:
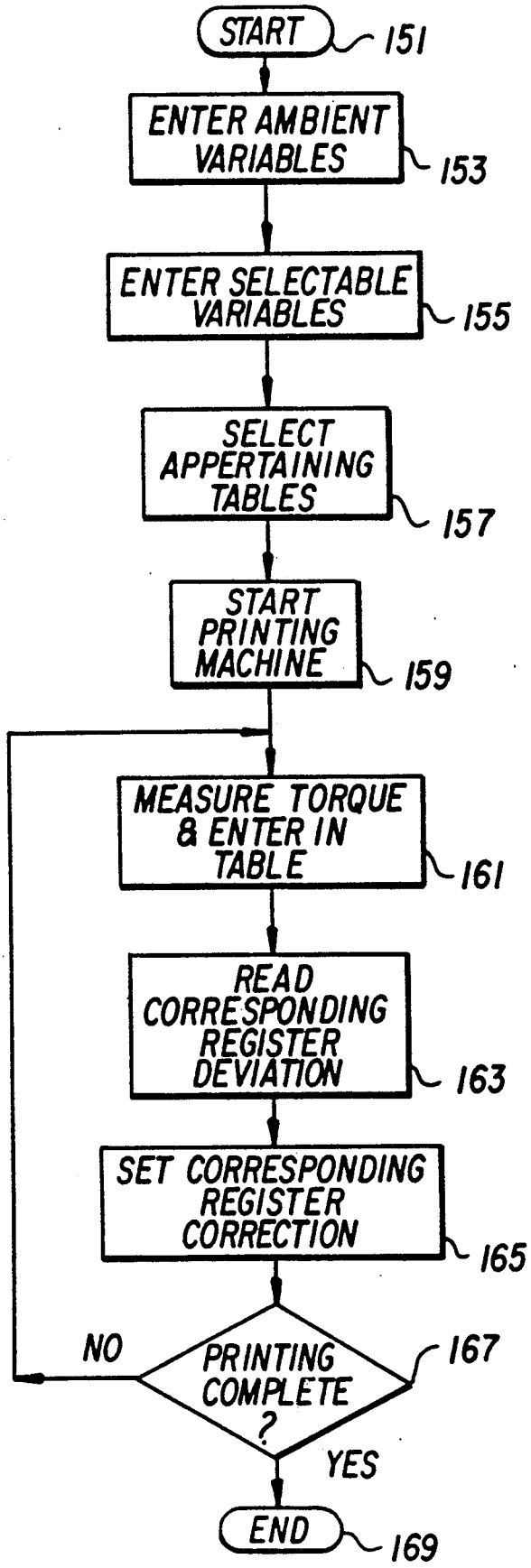
FIG. 7 is a flow-chart showing the steps of correcting the registers by means of the parameter table.

FIG. 7 is a flow-chart of the process of operating the printing machine from the parameter tables. After step 151, start, in step 153 the ambient variables are entered; in step 155 the selectable variables are entered, and in step 157, the computer automatically selects from the parameter memory 15 the appropriate appertaining parameter table. In step 161, the torque on the drive motor shaft is measured by the torque transducer 14, converted to digital value in the A-D converter 49, and entered as an address in the parameter table. In step 163 the corresponding register deviation is read and inserted into the register motor control 47 via the computer 16, and in step 165 the corresponding register 20 is set by its register motor 19.

An optional potentiometer 35 is mechanically linked to the angle changer control shaft 38 via linkage 36, 37 and electrically connected to the register motor control 47 via lead 41 in order to provide a position feed back for the register.

I claim:

1. Method for automatically resetting registers having register control in a rotary multi-color printing press having a plurality of printing units driven by a common motor, each unit having registers connected to respective register controls to correct for misalignment of the blanket cylinders caused by variable parameters in the torque on the common drive train means for driving the printing units, at least one table of variable parameters of corresponding torque and register angle deviations, and means for reading and writing said tables, the method which comprises:

writing said table in electronic memory, determining the torque on the drive train, using the torque to read the register deviation from the table, coupling the register controls to said table reading and writing means for obtaining the register angle deviations, and resetting the registers according to the read-out register angle deviations.

2. Method according to claim 1 which comprises preparing a variable parameter table by automatically recording the degree of blanket cylinder misalignment as a function of the variable parameters.

3. Method according to claim 1 which comprises preparing a parameter table by manually recording the degree of blanket cylinder misalignment as a function of the variable parameters.

4. Method according to claim 1 for automatically resetting the registers of a printing press wherein the preparing of the table in electronic memory further comprises:

selecting the rotary speed of the press as one of the variable parameters.

5. Method for automatically resetting the registers of a printing press according to claim 2 wherein the preparing of the table in electronic memory further comprises:

selecting any combination of variable parameters, the variable parameters which comprise ambient variables and selectable variables.

6. Method for, automatically resetting the registers of a printing press according to claim 2 wherein the preparing of the table in electronic memory further comprises:

selecting any combination of selectable variables, the selectable variables which comprise any combination of said printing units for operation of the press.

7. Method for automatically resetting the registers of a printing press according to claim 3 wherein the preparing of the table in electronic memory further comprises:

selecting any combination of ambient variables, the ambient variables which comprise temperature and humidity.

8. Method for automatically resetting a rotary printing press according to claim 4, further comprising:

Selecting any combination of selectable variables, the selectable variables which comprise type of ink and type of print carrier.

9. Apparatus for automatically resetting the registers having register controls, in a rotary multi-color printing press having a plurality of printing units to correct for misalignment of the blanket cylinders caused by variable parameters in loading on a common drive train driving the common printing unit, the apparatus which comprises:

a memory for storing in a parameter while the degree of misalignment as a function of the variable parameters, parameter table read and write means serving for receiving the variable parameters reading out the degree of misalignment from the table, and a register control coupled to the parameter table read and write means for receiving the degree of misalignment for resetting the registers to eliminate the misalignment.

10. Apparatus according to claim 9 further comprising:

a drive motor having a motor shaft, torque sensing means coupled to the motor shaft for producing a torque output proportional with the torque of the motor shaft, said torque output connected to the parameter table read and write means as one of the loading variables.

11. Apparatus according to claim 10 further comprising:

a keyboard for manually entering variable parameters into the parameter table read and write means.

12. Apparatus according to claim 9 wherein said variable parameters comprise ambient variables.

13. Apparatus according to claim 9 wherein said variable parameters comprise selectable variables.

14. Apparatus according to claim 9 wherein said variables comprise:

ambient variables and selectable variables.

15. Apparatus according to claim 10 wherein said ambient variables comprise temperature and humidity.

16. Apparatus according to claim 11 wherein said selectable variables comprise the selected number of operating printing units of said plurality of printing units.

17. Apparatus according to claim 11 further comprising:

an analog to digital converter interposed between said torque sensing means and said parameter table read and write means.

18. Apparatus according to claim 11 wherein said torque sensing means comprise strain gauges attached to the motor shaft.

19. Apparatus according to claim 11 wherein said torque sensing means comprise means for reading the motor input current and for converting the reading into torque output values.

* * * * *